United States Patent [19]

Lieber

[11] 4,075,459

[45] Feb. 21, 1978

[54] VOLTAGE TAPPING IN ELECTRICAL HEATING ELEMENTS

[75] Inventor: Ludwig Lieber, Steinweiler, Germany

[73] Assignee: Firma Fritz Eichenauer, Germany

[21] Appl. No.: 643,758

[22] Filed: Dec. 23, 1975

[30] Foreign Application Priority Data

Dec. 28, 1974 Germany ..... 2461754

[51] Int. Cl.[2] ..... H05B 3/02; F24H 3/04; H01C 1/148

[52] U.S. Cl. ..... 219/375; 219/381; 219/532; 219/541; 219/551; 338/58; 338/290; 338/323

[58] Field of Search ..... 219/374–376, 219/379–382, 532, 538, 542, 546, 369–371, 536, 541, 551; 338/315–321, 279–294, 57, 58, 322–325

[56] References Cited

U.S. PATENT DOCUMENTS 3,237,142 2/1966 Nuss ..... 338/58 X

FOREIGN PATENT DOCUMENTS 317,517 8/1929 United Kingdom ..... 338/288

*Primary Examiner*—A. Bartis
*Attorney, Agent, or Firm*—Craig & Antonelli

[57] ABSTRACT

A heater element for an electrical appliance (especially one having a blower, such as a fan heater, hair drier or the like) consists of a resistance heating wire looped in linear formation (e.g. zig-zag) and held transversely of the air flow direction by at least one support plate disposed parallel to said direction. The element has a voltage tapping point at the tip of one of the loops which projects beyond the other loops and has its tip fixed to an insulating panel parallel to said support plate. Said tip may be riveted or secured by an eye in a recess in said insulating plate.

4 Claims, 3 Drawing Figures

VOLTAGE TAPPING IN ELECTRICAL HEATING ELEMENTS

The invention relates to heating elements for electrical appliances, the heating element consisting of a resistance heating wire which is looped in linear formation, e.g. in zig-zag form, and of which the loops are held, in planes disposed in succession transversely of the flow direction of the air, by at least one support plate which is arranged parallel to the flow direction, and a voltage tapping on the loops for providing an electrical supply to a component of the appliance. Where the appliance is one having a motor-driven blower, such as a fan heater, a hair drier or the like, the tapped voltage supply may be used to energize the blower motor.

Heating elements having this construction are known (e.g. from German Pat. Nos. 1,185,743 and 1,256,335). These heating elements have proved to be satisfactory because of their desirable thermal and electrical behaviour and because of their self-supporting structure. Consequently, they are primarily used in connection with warm air appliances, such as space heaters, hair driers or the like.

With these appliances, the driving motor for the fan is generally operated at a low voltage from 8 to 24 volts. This low voltage is obtained in a simple manner by the voltage for the motor being tapped from the resistance heating wire over a length which is such that the required voltage drop is provided. The voltage tapping is in such cases usually produced by means of eyes or by rivets, which are provided in an appliance either already at the time that the heating element is manufactured or only subsequently when the said element is installed in an appliance.

The wiring which is necessary in these cases has to be carried out with great care, and this has the consequence that the assembly takes considerable time. This is more particularly the case with heater elements for small outputs, with which the external dimensions are correspondingly small. Also, it is not possible with such arrangements to exclude the possibility of the heating wire loops, with their very small wire thicknesses for relatively small outputs or capacities in the range from 250 to 500 watts, being damaged or distorted at the time of assembly.

An object of the invention is to provide, in connection with heating elements of the construction mentioned above, a voltage tapping which permits a simple and rapid assembly without the danger of there being any damage to the loops of the heating wire, more particularly of those intended for relatively small outputs.

To this end, according to the invention: at least one plate of insulating material, approximately parallel to the support plate, is arranged outside the region of the loops; and at least one loop, which serves as the voltage tapping, projects beyond the other loops and is fixed to that insulating plate by its loop tip in order to form a connection.

The complete assembly of the voltage tapping or tappings on the heating element is restricted to a fixing operation of the loop tips on the insulating material plate, so that the assembly cost is reduced. Furthermore, the tappings can be arranged in the smallest possible space, so that their utilization is particularly advantageous, more especially with small heating elements. Any danger of damage to the sensitive heating element is reduced, so that the proportion of rejects is diminished, because the fixing operation is effected easily and quickly and can also be carried out by unskilled labour. At the time of producing the looped resistance wire, it is only necessary for one loop to be made somewhat higher than the other loops, and this can easily be achieved in production technique.

In accordance with one preferred constructional form, the insulating material plate comprises at least one recess, in which is secured the tip of the loop, this tip at least projecting into the said recess. In this arrangement, the recesses are advantageously bores in which the tip of the loop is riveted or is secured by eyes, so that the voltage tappings are arranged in a manner which is functionally reliable and safe against loose contact.

A cable which leads to the blower motor, or other component requiring the tapped voltage supply, is preferably also riveted or secured by eyes at the same time, so that the fitting of the connecting cable to the voltage tapping can be carried out in a single operation. As an alternative, it is of course also possible for a soldering tab or the like to be riveted or secured by eyes at the same time to the tip of the loop, it then being possible for a cable to be soldered to the said tab or the like.

Other details, features and advantages of the invention will become apparent from the following description of one preferred constructional form and also from the accompanying drawing, in which.

Figure 1:
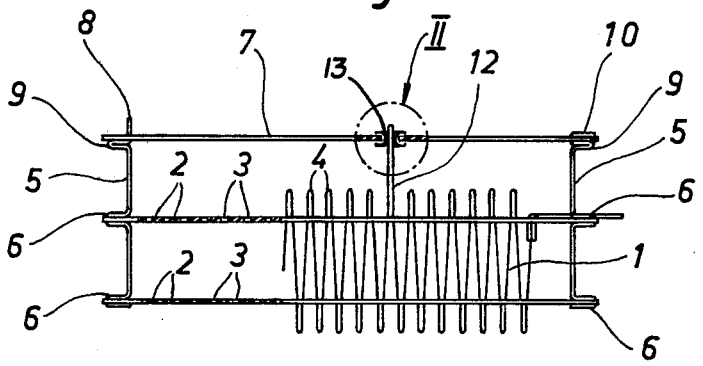
FIG. 1 shows the heating element in longitudinal section in a partially cut away longitudinal view.
Figure 2:
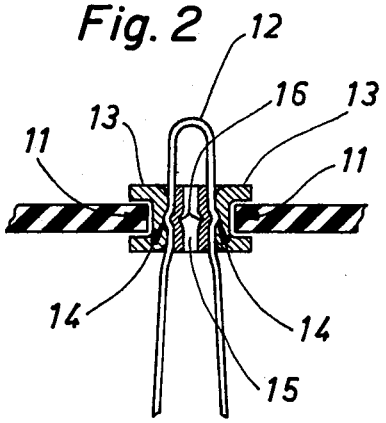
FIG. 2 shows, to a larger scale, the detail II in FIG. 1.
Figure 3:
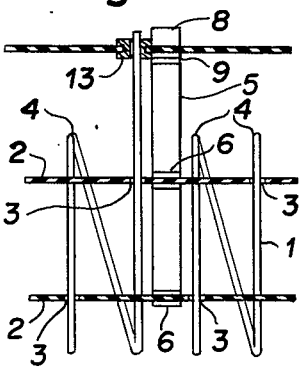
FIG. 3 illustrates a lateral sectional view of the heating element illustrated in FIG. 1.

Referring to the drawing, the heating element comprises a resistance heating wire 1, which is looped in zig-zag or meander formation. In this case, the loops are arranged in succession in several preferably parallel planes. The necessary three-dimensional rigidity for the resistance heating wire is obtained by two support plates 2 which are arranged parallel to one another and are formed with several rows of holes. These support plates 2 are fitted from both sides on to the tips 4 of the preformed loops and are pushed on to the said loops for a certain distance. As a result, the two wires of each loop tip are inserted in one of the holes 3.

The two support plates 2 are connected to one another by spacer members 5, for example, in the form of sheet metal strips, and, in the constructional example illustrated, these strips engage by means of a U-shaped sleeve formation 6 around the support plates 2 on their narrow sides.

Arranged above the loop tips 4 and parallel to the support plates 2 is an insulating material plate 7. The said plate 7 comprises punched-out holes on its narrow sides, through which the spacer members 5 are pushed. By bending over the ends 8 (indicated at 10 in the right-hand spacer member 5) and by a suitable step 9 disposed underneath the insulating plate 7, the said plate 7 is held in spaced relation. Instead of this arrangement, the insulating plate 7 can also be held by means of a sleeve formation which is similar to that used with the support plates 2. The insulating plate is formed with a recess 11, which is positioned at the point where the tip of a longer loop 12, projecting beyond the other loops, is disposed, so that the said longer loop projects at least into the recess.

In the recess 11, which is a bore in the constructional example illustrated, there is provided an eye 13, which is for example formed with a groove 14 extending around it on the inside. The longer loop 12 projects through the eye 13. Another eye 15, which has an encircling projection or rib 16 corresponding to the groove 14, clamps the longer loop 12 between it and the eye 13, so that the said loop is fixed reliably and safely on the insulating plate 7. At the same time, a cable can be connected to these eyes, which cable taps off the voltage drop, of 8 to 24 volts for example, existing over this length of wire. This voltage drop may be utilized as the necessary driving voltage for the motor of a blower in the appliance in which the element is employed. These small motors are generally direct current motors; where the heating element is operated with alternating voltage from the mains, rectifier diodes (not shown in the drawings) are fitted between the connections of the tapping and the blower motor. It is also possible for another diode to be provided, which only lops a half-wave of the mains current, whereby to make possible, for example, a two-stage control for the heater element. A suitable selector circuit would then have to be provided between the rectifier diodes and the additional diode.

The voltage tapping does not necessarily have to be for a blower; alternatively, or additionally, other active or passive components, to be operated with low voltage, can be connected thereto. The fixing of the longer loop 12 to the plate 7 of insulating material can also alternatively be effected by means of rivets.

I claim:

1. A heater element for an electrical appliance, said element consisting of a resistance heating wire which is looped as a series of reaches arranged in linear formation and having a plurality of tips with the loops being held against displacement, in planes disposed in succession transversely of the flow direction of the air, by at least one support plate which is arranged parallel to the flow direction, and a voltage tapping on the loops for providing an electrical supply to a component of the appliance, wherein at least one insulating material plate is arranged approximately parallel to said at least one support plate outside the region of the loops, and at least one of the loops, serving as a voltage tapping, projects beyond the other loops and the tip of said at least one loop is attached to one of said at least one insulating plate to form an electrical voltage tap connection.

2. A heater element according to claim 1, wherein the said insulating plate comprises at least one recess in which is fixed a loop tip, each of the said at least one tips at least projecting into respective ones of said recess.

3. A heater element according to claim 2, wherein the loop tip is secured by an eye in the recess.

4. A heater element according to claim 1, wherein said loop tips extending in one direction lie in a single plane and said insulating plate is spaced from said single plane.

* * * * *